United States Patent [19]

Thual

[11] 4,441,282

[45] Apr. 10, 1984

[54] SUSPENDED CEILING

[75] Inventor: Jacques G. L. Thual, Paris, France

[73] Assignee: Hunter Douglas International N.V. Rooi Catootje, Curacao, Netherlands

[21] Appl. No.: 370,207

[22] Filed: Apr. 21, 1982

[30] Foreign Application Priority Data

Apr. 24, 1981 [GB] United Kingdom ..... 8112724

[51] Int. Cl.[3] ..... E04F 19/00

[52] U.S. Cl. ..... 52/39; 248/58; 248/343

[58] Field of Search ..... 52/39, 29, 484; 248/58, 248/317, 343

[56] References Cited

U.S. PATENT DOCUMENTS 3,831,022 8/1974 Porter et al. ..... 248/343 X
4,137,678 2/1979 Varlonga ..... 52/39
4,170,843 10/1979 Talwani ..... 248/317
4,193,571 3/1980 Bula ..... 52/39 X

*Primary Examiner*—J. Karl Bell
*Attorney, Agent, or Firm*—Pennie & Edmonds

[57] ABSTRACT

A suspended ceiling, and components therefor, are described in which a carrying structure, for example in the form of carriers arranged in a grid, have depending therefrom a number of suspension units and a slat assembly, which may have decoratively disposed slats thereon, is mounted on each suspension unit. The arrangement is such that the slat assemblies are capable of at least limited rotation between a number of different positions, the slat assemblies being restrained in each position so that each slat assembly may have its orientation relative to its neighboring slat assemblies varied. This arrangement enables one to produce a very different visual effect simply by rotating certain of the slat assemblies relative to their neighbors. The specification discloses a number of different forms of slat assembly.

12 Claims, 11 Drawing Figures

SUSPENDED CEILING

DESCRIPTION

The present invention relates to a suspended ceiling.

Various forms of suspended ceiling have been proposed in the past, including various types of slat assembly which each give a particular visual effect. Once fixed in position, the visual effect remains until such time as the suspended ceiling is removed and/or replaced.

It is now proposed, according to the invention, to provide a suspended ceiling comprising a carrying structure, a plurality of suspension units depending from said carrying structure and a slat assembly mounted on each suspension unit, so as to be capable of at least limited rotation between a number of different positions, the slat assemblies being restrained in each such position, whereby each slat assembly may have its orientation relative to its neighbouring slat assemblies varied.

With such an arrangement, it is possible readily to change the visual effect simply by changing the relative position of certain of the slat assemblies to their neighbours. Thus, some of the slat assemblies can be rotated and others remain in the position in which they are, and if the slat assemblies are not symmetrical, this can give a totally different visual effect by simply altering the angle of rotation.

The carrying structure may be the ceiling itself of a room, hall or the like, or it may be a special carrier fitted to such a ceiling, for example, to form a grid-like arrangement on the ceiling.

Each suspension unit may comprise a substantially vertical rod-like means for supporting the slat assembly and a body member, the rotation of the slat being achieved by relative rotation between the rod-like means and the body member. The rod-like means may be mountable directly on the carrying structure and the member may be non-rotatably engageable on the carrying structure and the rod-like means be rotatable with respect to the member, and the respective slat assembly can be secured to the rod-like means against relative rotation with respect to the rod-like means.

Alternatively, the rod-like means can be fixed against relative rotation with respect to the carrying structure and the slat assembly is fixedly mounted on the member which is rotatable with respect to the rod-like means.

In either event, means may be provided to define discrete relative rotational positions between the rod-like means and the member, so that the slat assemblies may take up particular relative rotational positions without there being a full facility for rotation through infinitely small angles. Thus, the body member may be provided with a plurality of equi-angularly spaced detents or recesses and a disc may be fixedly mounted on the rod-like means and provided with recesses or detents which cooperate with the detents or recesses of the member defining the discrete positions. With such a construction, the rod-like means may be resiliently urged relative to the member to retain the detents and recesses in engagement, but permitting axial displacement whereby relative rotation can take place from one discrete position to another.

In another form of construction, the body member supports the slat assembly and is provided with a plurality of equi-angularly spaced, radially extending slots into which a transversely extending positioning means on the rod-like means, for example, a pin, can engage to define the discrete rotational positions.

With this construction, the member may be provided with slots on each axial end thereof, there being a different number of equi-angularly spaced slots on one end from those on the other, whereby different angular incremental positions can be taken up depending on whether the member is mounted one way up or the other.

Various orientations of the slats of the slat assembly are contemplated, but in a number of preferred constructions according to the invention, the slats are mounted with their plane substantially vertical. The slats may be flat and parallel to one another or angled with respect to one another or they may be curvilinear in form, or any combination of these arrangements.

According to another aspect of the invention, there is provided a component for a suspended ceiling comprising a suspension unit mountable below a carrying structure and a slat assembly mounted on said suspension unit so as to be capable of at least limited rotation between a number of different positions, the slat assembly being restrained in each such position.

In order that the present invention may more readily be understood, the following description is given, merely by way of example, reference being made to the accompanying drawings, in which.

Figure 1:
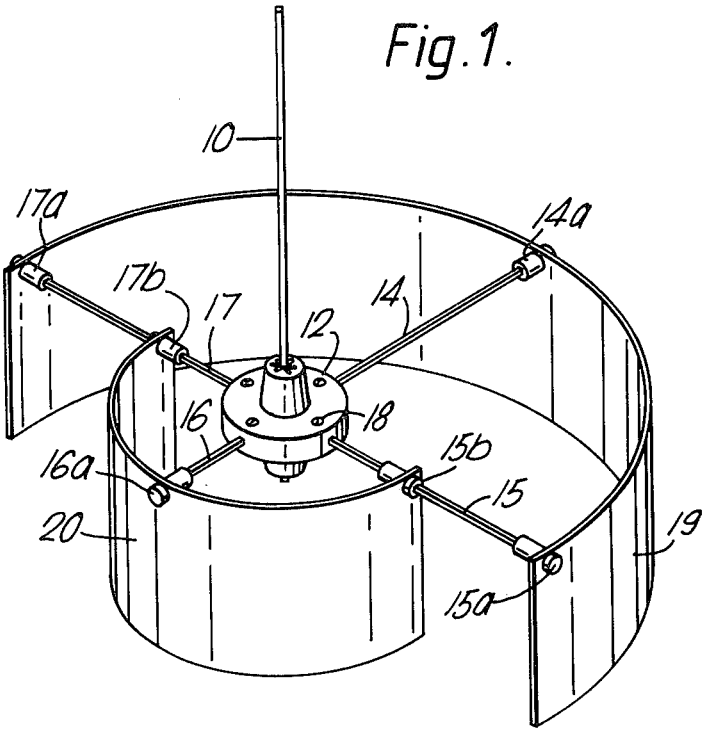
FIG. 1 is a perspective view of one embodiment of slat assembly used in a suspended ceiling according to the present invention.

Referring first to FIG. 1, the drawing illustrates a generally vertically extending rod which is secured to a carrying structure (not shown) thereabove, as will be explained in greater detail below.

Near the lower end of the rod 10 is a body member 12 which serves two functions. Firstly, it is rotatable relative to the rod. Secondly, it acts as a support for a slat assembly. For the second purpose, it has, extending in a generally horizontal plane, and radially outward therefrom, four mounting bars 14,15,16 and 17 which are secured to the body member 12 by screws, one of which is indicated by the reference numeral 18.

The bars 14,15,16 and 17 have at their ends a securing element 14a,15a,16a and 17a respectively, while the bars 15 and 17 have, intermediate their ends, further securing elements 15b and 17b respectively.

The securing elements 17a, 14a and 15a are each engaged in apertures formed in a large semi-cylindrical slat 19, while the securing elements 15b, 16a, 17b are similarly mounted in a small semi-cylindrical slat 20.

A suspended ceiling will consist of a plurality of suspension units including the rod 10 and the supporting elements 12 with their associated slat assemblies mounted on a carrying structure which may be in the form of a grid of generally horizontally extending carriers. The nature of the ceiling can readily be altered by altering the relative rotational positions of the slat assemblies as will be explained later.

Figure 2:
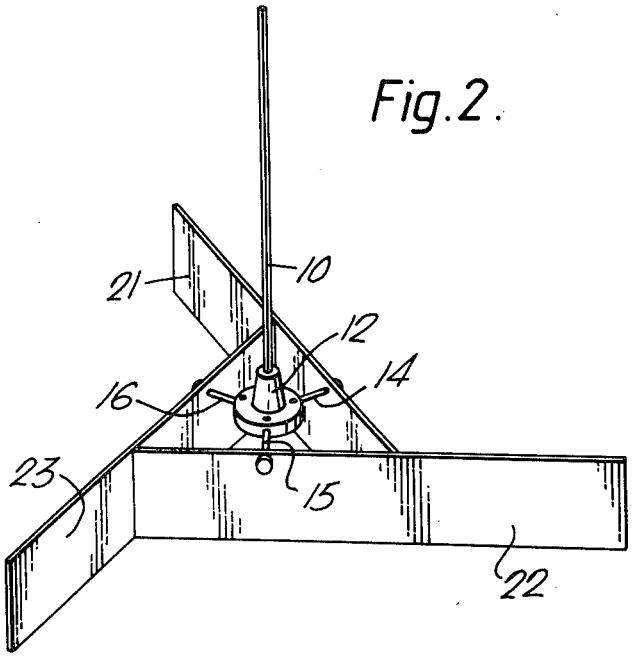
FIG. 2 is a similar view of a second construction thereof.

FIG. 2 shows a similar structure, but here the supporting element 12 has only three equi-angularly spaced bars 14,15 and 16 and these each support a flat slat 21,22, 23 respectively, which, in the illustrated construction, is in the form of a generally rectangular shape, providing a triangular centre with three legs. Again the relative positions can be altered.

Figure 3:
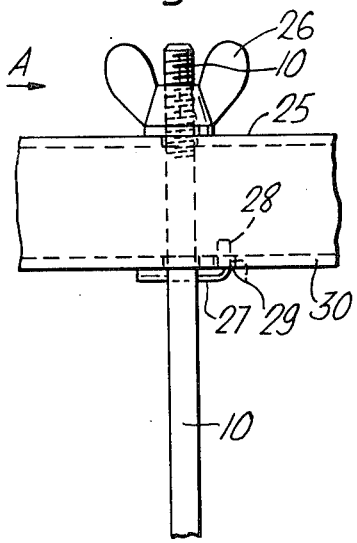
FIG. 3 is a scrap side elevation showing how the suspension unit is mounted on the carrying structure.
Figure 4:
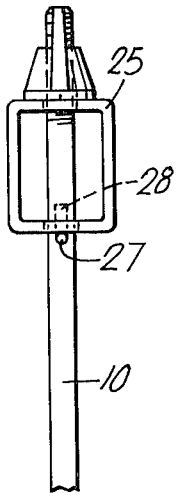
FIG. 4 is a view in the direction of the arrow A in FIG. 3.
Figure 6:
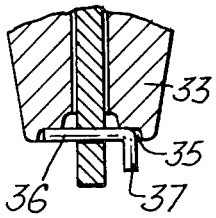
FIG. 6 is a scrap section of the bottom portion of the member of FIG. 5.

Turning now to FIGS. 3 and 4, the rod 10 is shown mounted on a horizontally extending carrier 25 forming part of a carrying structure. It will be seen that the upper 1Oa of the rod 10 is threaded and the rod is secured in position by a wing nut 26.

Below the carrier 25, the rod 10 is provided with a transversely extending pin 27 having an upturned end portion 28 extending through an aperture 29 in a lower flange 30 on the carrier. Thus, when the wing nut 26 is tightened up, the rod 10 is prevented from rotation.

Figure 7:
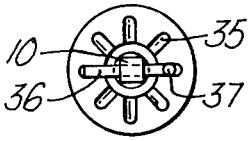
FIG. 7 is an underneath plan view of the portion shown in FIG. 6.
Figure 5:
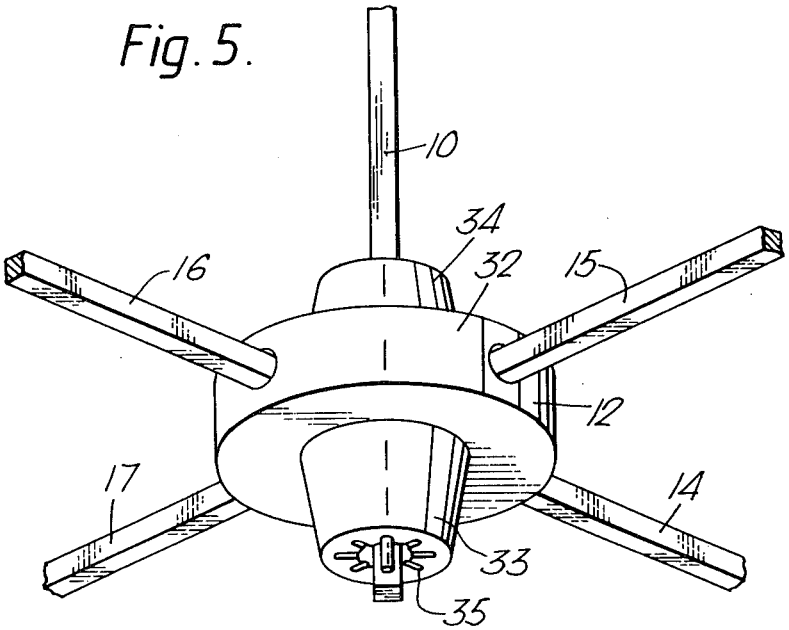
FIG. 5 is a fragmentary underneath perspective view showing one form of the slat assembly mounting member.

The suspension unit includes, in addition to the rod 10, a supporting element 12, as explained above. This member 12 consists of a generally cylindrical portion 32 having axially extending frusto-conical lower and upper hubs 33 and 34. As can be seen from FIG. 5, the hub is provided with eight equi-angularly spaced radially extending slots 35 and the rod is provided with a lower transversely extending pin 36 having a downturned portion 37. The radial extent of the pin 36 is slightly less than the radial extent of the slots 35. It will be appreciated that the weight of the slat assembly will hold the upper portions 33 and thus the slots 35 therein, in engagement with the pin 36 and this in itself will prevent the slat assembly from rotating. The arrangement can be seen clearly in FIG. 7 from which it can also be seen that the cross-section of the rod 10 is generally square, thus increasing the rigidity of the rod.

Figure 8:
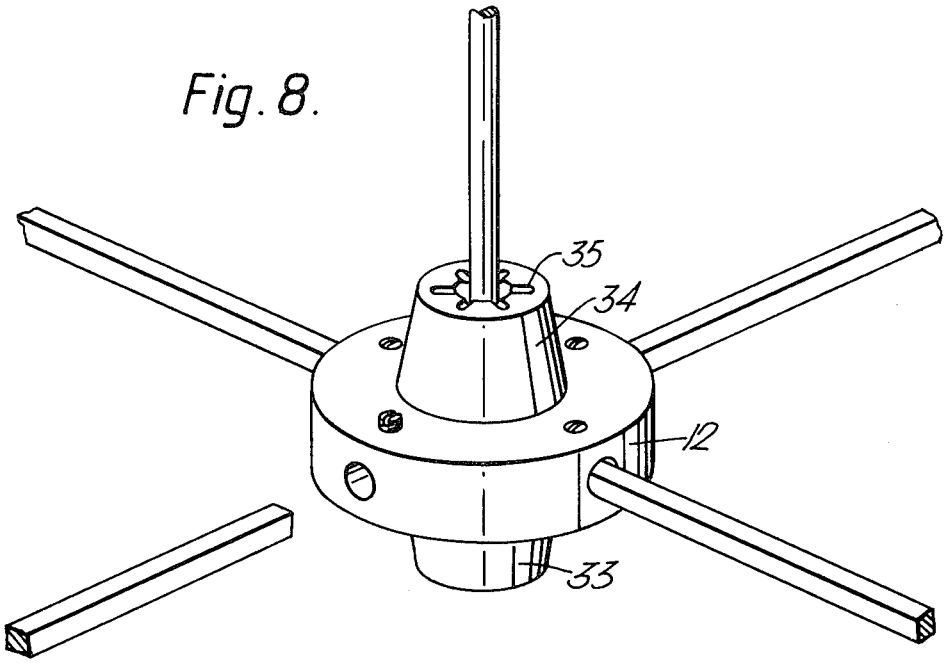
FIG. 8 is a perspective view from above of the member of FIG. 5.

If reference is now made to FIG. 8, it will be seen that the upper hub portion 34 is shown with six slots 35 rather than the eight slots 35 of the hub portion 33. Thus, if the member 12 is inverted, so that the hub portion 34 is at the bottom, the angular displacement which can be achieved is different from that with the hub portion 33 at the lowermost position. Inversion is usually done before attaching the slats.

If one ever wishes to alter the orientation of the slat assembly, one will simply lift the member 12 and rotate it the desired angular increment and then lower it again so that the appropriate slot is engaged on the pin. The body member 12 serves two purposes. Firstly, it acts as a member which is rotatable relative to the rod and secondly, it acts as a supporting element for the slat assembly.

Figure 9:
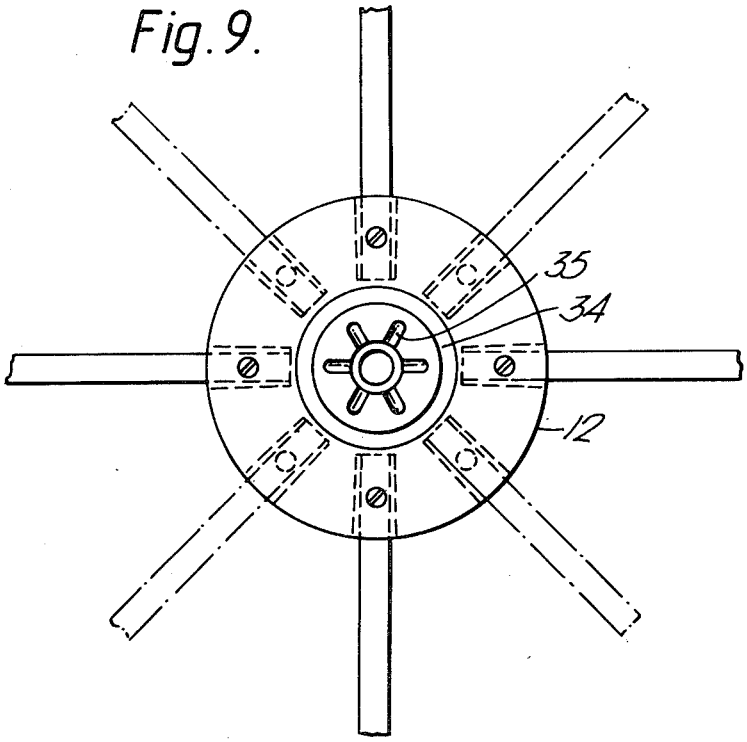
FIG. 9 is an underneath plan view showing a modification of the mounting member.

FIG. 9 shows a further construction in which, instead of four bars 14,15,16 and 17, eight bars can be provided. Of course, provision for any other number of bars could be made if desired.

Figure 10:
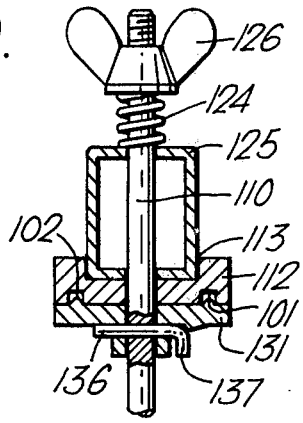
FIG. 10 is a scrap section through a portion of a carrying structure and an alternative embodiment according to the invention.
Figure 11:
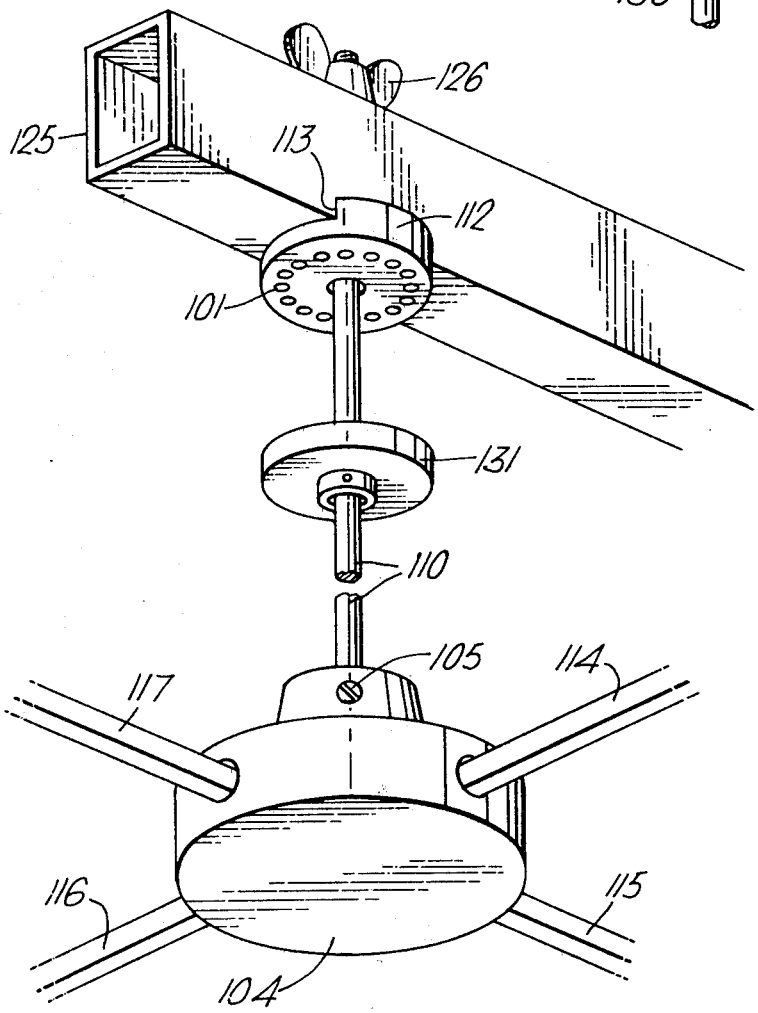
FIG. 11 is an underneath perspective view showing schematically the carrying structure, the support rod, the member and a slat assembly supporting member of the construction of FIG. 10.

FIGS. 10 and 11 show a somewhat different construction. FIG. 10 shows a carrier 125 of a carrying structure through which passes a vertical rod 110 held in place by a wing nut 126 with the interposition of a compression spring 124.

The rod 110 holds in place a member 112 which has a recess 113 in its upper surface which accommodates the lower part of the carrier 125, to prevent the member 112 from rotating. A transverse pin 136 having a downturned portion 137 holds a disc 131 which is normally in abutting relation with the member 112. It will be seen that the member 112 has a number of equi-angularly spaced recesses 101 while the disc 131 has cooperating equi-angularly spaced detents 102 therein. It will be appreciated that the effect of the spring 124 is to retain the detents 102 in engagement with the recesses 101 thereby to prevent easy rotation of the disc 131, and therefore of the rod 110 (which is held against rotation relative to the disc by the pin 136).

At its lower end the rod 110 has mounted thereon a body member or supporting element 104 which is prevented from rotation relative to the rod 110 by a fixing screw 105. Bars 114, 115,116 and 117 are secured as appropriate to the element 104 and the same function as the bars 14,15,16, and 17 respectively in the construction illustrated in FIG. 1. The remainder of the slat assembly can take up, for example, the form shown in FIG. 1 or that shown in FIG. 2.

When it is desired to change the relative orientation of the two slat assemblies, one simply rotates the member 104, which will cause the rod 110 to rotate, this being accommodated by the spring 124 allowing the rod 110 to drop slightly, so that the detents 102 can disengage from the recesses 101 and allow incremental discrete angular displacement.

The spring 124 will urge the rod upwardly so that the disc 131 is locked in the rotational position which has been selected. With the construction of FIGS. 10 and 11, the member 112 serves the function of holding the whole assembly on a carrier and also, in effect, acts as a bearing enabling the rod to rotate. The rotational function, however, is, to a certain extent, separated and is carried out by the disc 131 which is rotatable relative to the member 112.

The member 104 serves a totally separate function which is to support the arms 114,115,116 and 117. Thus, the function of the member 12 of the first embodiment is separated into two separate elements in FIGS. 10 and 11.

It will be appreciated that in the constructions illustrated so far, the bars 14 to 17 have been shown extending in a generally horizontal plane, that is perpendicular to the support rod 10. It is contemplated that they could be arranged other than in a horizontal plane, for example all depending downwardly or upwardly, or some depending downwardly and some upwardly.

While the "slats" 19 to 23 have been shown extending in a substantially vertical plane, it is also contemplated that some, or all, could be arranged other than in a vertical plane. For example, some could be in a vertical plane and others angled or in a generally horizontal plane. Provision could be made for the angular inclination or general position of the slats to be altered in a particular assembly. The angular displacement, relative to the vertical plane, of the slats could be achieved either by arranging the slats at an angle to the bars and/or arranging the bars to be at an angle to the slat supporting element 12 or 104.

FIGS. 5 to 8 show how one can achieve an angular variation of 45° or 60°. FIG. 11 shows that one can achieve an angular displacement of 22.5°. Any other angular displacement could be chosen in either of these types of construction by providing an appropriate number of grooves or detents.

Numerous other constructions of slat assembly are contemplated other than those illustrated in FIGS. 1 and 2. The present invention is not directed to any particular slat configuration.

Basically, however, with a given form of slat assembly, one can readily achieve a different effect with the construction according to the present invention. Simply by rotating through a certain angle at any one or more of the slat assemblies, relative to their neighbours, one can vary the overall effect very significantly. For example, if in one particular arrangement, the construction of FIG. 1 could be provided all over a ceiling area, with all of the slat assemblies in the same orientation. If one altered the orientation of several of the slat assemblies, but not all, the visual effect could be materially different. Furthermore, one could given an even more varied effect by using slat assemblies of two or more different constructions.

The slat assemblies according to the present invention are normally of the see-through type so that illumination can be provided from above the slat assemblies.

I claim:

1. A suspended ceiling comprising a carrying structure, a plurality of suspension units depending from said carrying structure, a plurality of slat assemblies each comprising a number of slats arranged to form a decorative pattern, each said slat assembly being mounted on one suspension unit, so as to be capable of at least limited rotation between a number of preselected different positions, and means to restrain the slat assemblies in each such position, whereby each slat assembly may have its orientation relative to its neighbouring slat assemblies varied, thereby varying the overall ceiling pattern.

2. A suspended ceiling according to claim 1, wherein each suspension unit comprises a substantially vertical rod-like means for supporting the slat assembly.

3. A suspended ceiling according to claim 2 whereby the slat assembly is fixedly connected to the rod-like means and said rod-like means being rotatably mounted to said carrying structure.

4. A suspended ceiling according to claim 2 wherein the rod-like means is adapted to be non-rotatably fixed to the carrying structure, and the slat assembly is fixedly mounted on a body member and further comprising means to define discrete relative rotational positions between the rod and said body.

5. A suspended ceiling according to claim 4, and further comprising a plurality of equi-angularly spaced radially extending slots on said member and a transversely extending positioning means on the rod-like means, engageable into one of said slots to define the discrete rotational positions.

6. A suspended ceiling according to claim 5, wherein the member further comprises slots on each axial end thereof, there being a different number of equi-angularly spaced slots on one end from those on the other, whereby different angular incremental positions can be taken up depending on whether the body member is mounted one way up or the other.

7. A suspended ceiling according to claim 4, and further comprising fixing means on said member for fixedly mounting the inner ends of slat carrying bars extending generally transverse to the rods.

8. A suspended ceiling according to claim 1, wherein the slats of a slat assembly are oriented with their planes substantially vertical.

9. A suspended ceiling according to claim 4, wherein the member includes axially extending hubs at each axial end to increase the bearing load of the member on the rod-like means.

10. A component for a suspended ceiling, comprising a suspension unit mountable below a carrying structure, and a slat assembly mounted on said suspension unit so as to be capable of at least limited rotation between a number of preselected different positions, the slat assembly being retained in each such position.

11. A component according to claim 10, wherein the suspension unit comprises a rod fixedly mountable on the carrying structure, a member rotatable relative to the rod, a transversely extending pin projecting radially outwardly from the rod, a plurality of equi-angularly spaced radially extending slots on said member into which the pin can engage to define a discrete rotational position, and wherein the slat assembly is fixedly mounted on the member.

12. A component according to claim 10, wherein a member is fixable to the carrying structure, and further comprising a substantially vertically extending rod rotatable relative thereto, the slat assembly being secured on a supporting element fixed on said rod against relative rotation, a plurality of equi-angularly spaced detents or recesses on said member, and a disc fixedly mounted on the rod, recesses or detents on said disc cooperating with the detents or recesses of the member to define discrete rotational positions, the rod being resiliently urged relative to the member to retain the detents or recess in engagement, but permitting axial displacement, whereby relative rotation can take place from one discrete position to another.

* * * * *

UNITED STATES PATENT AND TRADEMARK OFFICE

CERTIFICATE OF CORRECTION

PATENT NO. : 4,441,282

DATED : April 10, 1984

INVENTOR(S) : JACQUES G. L. THUAL

It is certified that error appears in the above-identified patent and that said Letters Patent is hereby corrected as shown below:

Col. 2, line 62, "member 12 which serves" should read --member or supporting element 12 which serves--;

Signed and Sealed this

Fifth Day of June 1984

[SEAL]

*Attest:*

GERALD J. MOSSINGHOFF

*Attesting Officer*

*Commissioner of Patents and Trademarks*